United States Patent [19]

Izumi et al.

[11] 3,967,985

[45] July 6, 1976

[54] PROCESS FOR TREATING SURFACES OF A PERFORATED MASK

[75] Inventors: Akiya Izumi; Shigemi Hirasawa; Yoshifumi Tomita, all of Mobara, Japan

[73] Assignee: Hitachi, Ltd., Japan

[22] Filed: Oct. 12, 1973

[21] Appl. No.: 405,841

[30] Foreign Application Priority Data

Oct. 18, 1972 Japan ..... 47-103583

[52] U.S. Cl. ..... 148/6.35; 148/6.15 R

[51] Int. Cl.[2] ..... C23F 7/10; C23F 7/04

[58] Field of Search ..... 148/6.15 Z, 6.35, 6.15 R

[56] References Cited

UNITED STATES PATENTS

| | | | |
|---|---|---|---|
| 2,529,414 | 11/1950 | Pfeffer | 117/49 |
| 2,979,430 | 4/1961 | Keller et al. | 148/6.15 R |
| 3,015,594 | 1/1962 | Russell | 148/6.15 Z |
| 3,060,066 | 8/1962 | Ross et al. | 148/6.15 R |
| 3,372,064 | 3/1968 | Jones et al. | 148/6.15 Z |
| 3,644,152 | 2/1972 | Schlossberg et al. | 148/6.15 R |
| 3,749,611 | 7/1931 | Leon et al. | 148/6.15 R |

*Primary Examiner*—Cameron K. Weiffenbach
*Assistant Examiner*—R. Eugene Varndell, Jr.
*Attorney, Agent, or Firm*—Craig & Antonelli

[57] ABSTRACT

Surfaces of a perforated mask made of iron are allowed to contact with an acidic aqueous solution of antimony trichloride, e.g., a hydrochloric acid solution to form a thin film of metallic antimony on said surfaces. A protective coating of a phosphate is allowed to be deposited onto said thin film. Thereafter, said surfaces is heated in an oxygen atmosphere to produce a grayish black coating having an excellent thermal emission power. The perforated mask thus treated has no permanent deformation like wrinkles produced at a perforated sheet member and is uniform in color.

13 Claims, No Drawings

PROCESS FOR TREATING SURFACES OF A PERFORATED MASK

BACKGROUND OF THE INVENTION

1. Field of Invention

The present invention relates to a process for treating a surface of a perforated mask made of iron. The process provides a grayish black coating having an excellent thermal emission power on the mask by a predetermined heat treatment.

2. Description of Prior Art

A perforated mask used as a color-selecting electrode of a color picture tube such as a black matrix type color picture tube has been almost made of iron recently and, in some cases, manufactured by forming fluorescent dots or fluorescent stripes and then expanding pores for electron beams by the post-etching technique.

A post-etched perforated mask has a surface of metal exposed. Therefore, if any surface treatment is not effected to such mask, red rust is partially produced by a post heat treatment. This rust is peeled and adheres to the perforated mask. Thus, some pores of the mask are blocked. And some of electron beams are lacked. Further, the temperature of the surface of the perforated mask is raised by scanning the mask with electron beams, because of a poor thermal emission power of the mask after heat treating and, therefore, reversible thermal expansion of the mask occurs. As a result, electron beams have a great tendency to deviate from the corresponding fluorescent elements and inconveniently produce non-uniformity of color.

Therefore, for improving a thermal emission power there has been heretofore employed a process in which a black film of ferrosoferric oxide is formed on the surface of the mask by the chemically blackening method. The rust proofing as well as the thermal emission power is improved by the process.

This process is carried out by using an about 50% solution of caustic soda and at a temperature of about 140°C. When a mask to be treated is dipped into the solution, the difference in thermal expansion between a frame member and a perforated sheet member of the mask occurs due to the difference in heat capacity between the two members. Thus, permanent deformation like wrinkles are produced on the perforated sheet member. These wrinkles cause a non-uniformity of color.

This process uses a strong alkaline solution at an elevated temperature and, therefore, is accompanied with a great danger and further requires a waste-water treating system having a large scale.

SUMMARY OF THE INVENTION

The object of the present invention is to provide a process for treating surfaces of a perforated mask made of iron for use in a color picture tube to produce a grayish black coating having an excellent thermal emission power on the surface without producing partially red rust.

Another object of the present invention is to provide the process in which no permanent deformation like wrinkles are produced on a perforated sheet member of the perforated mask made of iron.

Further object of the present invention is to provide a process in which a waste-water treating system having a large scale is not required and which is accompanied with less danger by using a weakly acidic treating solution.

According to the present invention, it has been found that these objects are achieved by bringing the surfaces of a perforated mask made of iron into contact with an acidic aqueous solution of antimony trichloride to form a thin film of metallic antimony on said surfaces and allowing a protective coating of a phosphate to be deposited onto said thin film and, thereafter heating the mask in an oxygen atmosphere, thereby producing on the surfaces a grayish black coating having an excellent thermal emission power.

The present invention will be described in more detail below.

The surfaces of a perforated mask made of iron are brought into contact with a hydrochloric acid solution of antimony trichloride by dipping, spraying, brushing or etc., immediately after subjecting the surfaces to the post-etching treatment, thereby forming a thin film of metallic antimony on the surfaces. The concentration of hydrochloric acid used ranges from 20 to 60 g./l., preferably from 46 to 52 g./l. The concentration of antimony trichloride used ranges from 0.41 to 2.45 g./l., preferably from 1.63 to 2.04 g./l. The temperature of the solution is not more than 15°C which is sufficient to form a uniform thin film, preferably as low as from 5° to 10°C. The contact time varies depending upon the concentration of antimony trichloride and the temperature of the solution, but is normally shorter than 2 minutes, preferably from 25 to 50 seconds.

Next, the solution is removed from said surfaces by dipping them into water or spraying them with water. In the case of the spraying, the spray pressure is desirably below 0.2 Kg./cm$^2$.

The thin film of metallic antimony thus formed is allowed to be in contact with a solution of a phosphate by means of, for example, dipping or spraying, thereby depositing a protective coating of the phosphate on the thin film. This deposition of the protective film is carried out for the purpose of preventing red rust from partially forming during heat treating. Various well-known phosphates may be used in the present invention. Particularly, a solution of iron phosphate, for example, BONDELITE No. 3456 (mainly composed of $NaH_2PO_4$) from Nihon Perkerlizing K.K., is suitable.

The solution of a phosphate is desirably adjusted to a total acidity of 10 to 13 points. Further, as depositing conditions, an acid consumption is −0.9 to −1.5, a solution temperature is below 60°C., desirably 40° to 45°C., and a contact time is below 3 minutes, desirably 25 to 50 seconds. The protective coating should be as thin as possible but should have the effect of preventing red rust from forming. If said coating is too thick, then the thermal emission power after heat treating is lowered and, therefore, such thick coating is not suitable.

The protective coating thus deposited is washed with water by means of dipping or spraying and an excessive solution is removed. Then it is dried in air.

After forming the thin film of metallic antimony and depositing the protective coating of a phosphate on the surfaces, the surfaces are heated in an oxygen atmosphere such as air at a temperature of 350° to 600°C., desirably about 400°C. The heating time is 1 to 5 hours, desirably about 3 hours. After heating, a grayish black coating is formed on the surfaces.

The presence of the thin film of metallic antimony formed on the surfaces of the mask promotes the oxidation of the ferrous surfaces with oxygen during heat treating. Such oxidation promotes the growth of whisker-like crystals having a length of 0.3 to 1.0 $\mu$. These crystals constitute the grayish black coating having an excellent thermal emission power.

Next, the present invention will be illustrated by the following example.

DESCRIPTION OF PREFERRED EMBODIMENT

EXAMPLE

A perforated mask made of iron was dipped into an aqueous solution containing 51.5 grs./l. hydrochloric acid and 1.84 gr./l. antimony trichloride at 10°C. for about 50 seconds, immediately after post-etching it and before drying it. Thereafter, the mask is washed by spraying with tap water at room temperature under pressure of 0.2 Kg/cm² for about 25 seconds. Then an aqueous solution containing BONDELITE No. 3456 from Nihon Perkerlizing K.K. was sprayed onto the surfaces of the mask at 40°C. and under pressure of 0.5 Kg/cm² for about 25 seconds. A total acidity was 11.5 points and an acid consumption was −1.1 points. The surfaces were washed by spraying with tap water under pressure of 0.5 Kg/cm² for about 75 seconds, and then dried in a hot blast drying furnace operating at 60°C. for about 2 minutes. Thereafter, the surfaces were subjected to a heat treatment in air at 420°C. for about 3 hours. Thus, a grayish black coating having an excellent grayish black coating was produced.

In the above, the structure having a frame member was illustrated, but it should be noted that the structure having no frame member also has the same effects.

What is claimed is:

1. A process for treating surfaces of a perforated mask made of iron, comprising bringing at least one surface of the perforated mask in contact with an acidic aqueous solution of antimony trichloride to form a thin film of metallic antimony, depositing a protective coating of a phosphate onto said thin film and heating said coated surfaces in an oxygen atmosphere at 350° to 600°C for 1 to 5 hours, thereby producing a grayish black coating having an excellent thermal emission power on said surfaces of the perforated mask for use in a color picture tube.

2. The process according to claim 1, wherein the acidic aqueous solution of antimony trichloride is a hydrochloric acid solution of antimony trichloride.

3. The process according to claim 2, wherein said hydrochloric acid solution of antimony trichloride contains 20 to 60 grs./l hydrochloric acid and 0.41 to 2.45 grs./l., antimony trichloride.

4. The process according to claim 3, wherein the temperature of the acidic aqueous solution of antimony trichloride is below 15°C. the contact time below 2 minutes.

5. The process according to claim 2, wherein said hydrochloric acid solution of antimony trichloride contains 46 to 52 grs./l. hydrochloric acid and 1.63 to 2.04 grs./l. antimony trichloride.

6. The process according to claim 5, wherein the temperature of the acidic aqueous solution of antimony trichloride if from 5° to 10°C. and the contact time is from 25 to 50 seconds.

7. The process according to claim 1, wherein the phosphate is iron phosphate.

8. The process according to claim 7, wherein the total acidity of the solution of a phosphate is 10 to 13 points, the acid consumption −0.9 to −1.5 points, the temperature of the solution below 60°C., and the contact time below 3 minutes.

9. The process according to claim 7, wherein the total acidity of the solution of a phosphate is 10 to 13 points, the acid consumption −0.9 to 1.5 points, the temperature of the solution from 40° to 45°C. and the contact time from 25 to 50 seconds.

10. The process according to claim 7, wherein said grayish black coating is made up of whisker-like crystals having a length of 0.3 to 1.0$\mu$ which are formed by the oxidation of the ferrous surfaces of said perforated mask.

11. The process according to claim 1, wherein the phosphate coating is deposited on said thin film by contacting the thin film with a solution of the phosphate.

12. The process according to claim 1, wherein said coated surfaces are heated for a period of time sufficient to promote the oxidation of the ferrous surfaces of said mask with oxygen and to promote the growth of whisker-like crystals having a length of about 0.3 to 1.0$\mu$.

13. The process according to claim 1, wherein said acidic aqueous solution of antimony trichloride contains 0.41 to 2.45 grs./l antimony chloride, wherein the temperature of the acidic aqueous solution of antimony chloride is below 15°C when contacted with said at least one surface, and further wherein the contact time of the acidic aqueous solution of antimony trichloride with said at least one surface is below 2 minutes.

* * * * *